United States Patent [19]

Chen

[11] Patent Number: 4,530,479

[45] Date of Patent: Jul. 23, 1985

[54] SOAP BASKET

[76] Inventor: Jason K. Chen, No. 17 La. 541, Sung Shan Rd., Taipei, Taiwan

[21] Appl. No.: 539,812

[22] Filed: Oct. 7, 1983

[51] Int. Cl.[3] ..... A47F 5/00

[52] U.S. Cl. ..... 248/309.1; 248/311.2; 312/351

[58] Field of Search ..... 248/309.1, 309.2, 316.8, 248/311.2; 211/88; 15/105; 312/351; D6/537, 540

[56] References Cited

U.S. PATENT DOCUMENTS

| | | | |
|---|---|---|---|
| D. 160,279 | 9/1950 | Sindler | D6/540 |
| 1,784,155 | 12/1930 | Moineau | 248/309.1 |
| 2,359,797 | 10/1944 | Schnider | 312/351 |
| 2,575,843 | 11/1951 | Semrow | 248/316.8 X |
| 3,251,639 | 5/1966 | Silowash | 248/316.8 X |
| 3,664,622 | 5/1972 | Vaccaro | 248/312.1 X |
| 4,234,094 | 11/1980 | Jorgensen | 211/88 |

*Primary Examiner*—J. Franklin Foss

*Attorney, Agent, or Firm*—Shoemaker and Mattare, Ltd.

[57] ABSTRACT

A basket assembly to be hung on the wall of a bathroom for keeping a bar of wet soap, comprising a basket, a soap holder detachably mounted onto the boom of the basket, and a hanger on which the basket is hung, the soap holder having a plurality of bar members spacially arranged in two rows so that a bar of soap may be held between the two rows of the standed bar members. A vessel-shaped adaptor is provided to fit the soap holder to enable the basket assembly to be converted into a wall vase as one may wish.

6 Claims, 6 Drawing Figures

SOAP BASKET

BACKGROUND OF THE INVENTION

This invention relates to a soap basket for keeping a bar of soap, particularly a wet bar of soap, in a bathroom.

Wet bars of soap are slippery. Though there are places in a bathroom such as a slight cavity spot formed on the bathroom cabinet or on the flange of the bath tub for placing a wet bar of soap, yet the wet bar of soap still tends to slip out of place since the cavity is normally very shallow so as to avoid accumulation of water.

A soap dish is commonly used to keep a wet bar of soap. A soap dish is generally provided with drain holes so as to allow the solute of the soap to flow through. However, these drain holes tend to clog quickly from soap sludge thus causing water to accumulate in the soap dish and to soak the soap all the time.

In view of the aforesaid problem the present invention offers a novel soap basket for keeping a bar of wet soap.

Therefore it is a primary object of this invention to provide a soap basket that can be conveniently hung on the wall of a bathroom and which is capable of keeping a wet bar of soap from being soaked in water.

BRIEF DESCRIPTION OF THE INVENTION

The soap basket of this invention is a basket assembly which comprises a basket formed of a net-like frame work having a flange; a soap holder detachably mounted in the basket; and a hanger plate to which the basket is hooked, the hanger plate being adapted to be mounted on the wall of a bathroom. The soap holder comprises a plurality of bar members arranged in two rows spaced apart from each other, wherein the bar members of one row are spacially arranged in parallel to correspond with the bar members of the opposite, second row, so as to hold a bar of soap upright between the two rows of bar members. A vessel-shaped adaptor is provided to fit the soap holder to enable the soap basket to be converted into a wall vase as one may wish.

DETAILED DESCRIPTION OF THE INVENTION

Figure 1:
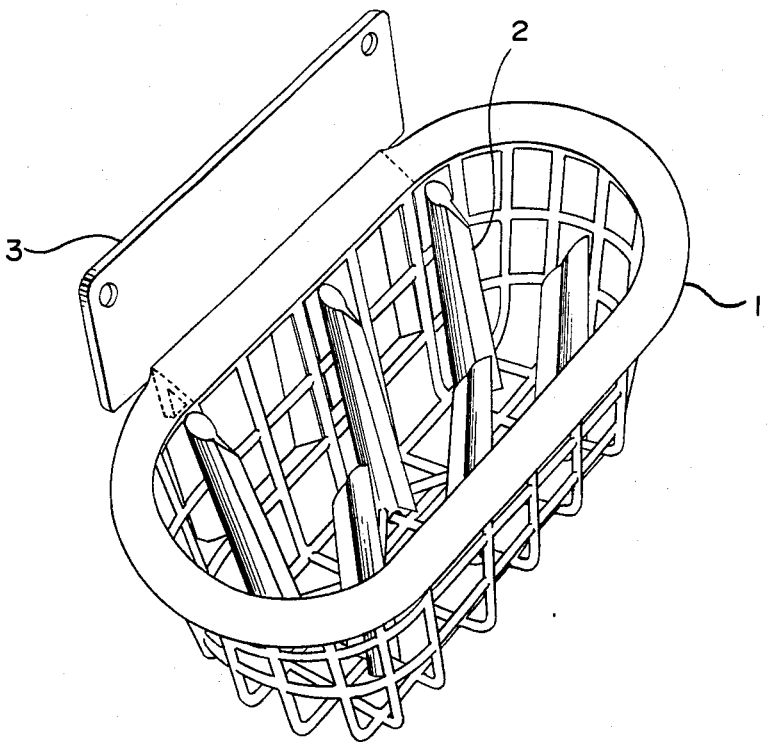
FIG. 1 is an oblique, perspective view of the soap basket of this invention, with the soap holder assembled and with the basket hooked onto the hanger plate, having the flange partially cut away.

As shown in FIG. 1, the soap basket of this invention is a basket assembly which comprises a basket 1, a soap holder 2, and a hanger plate 3

Figure 2:
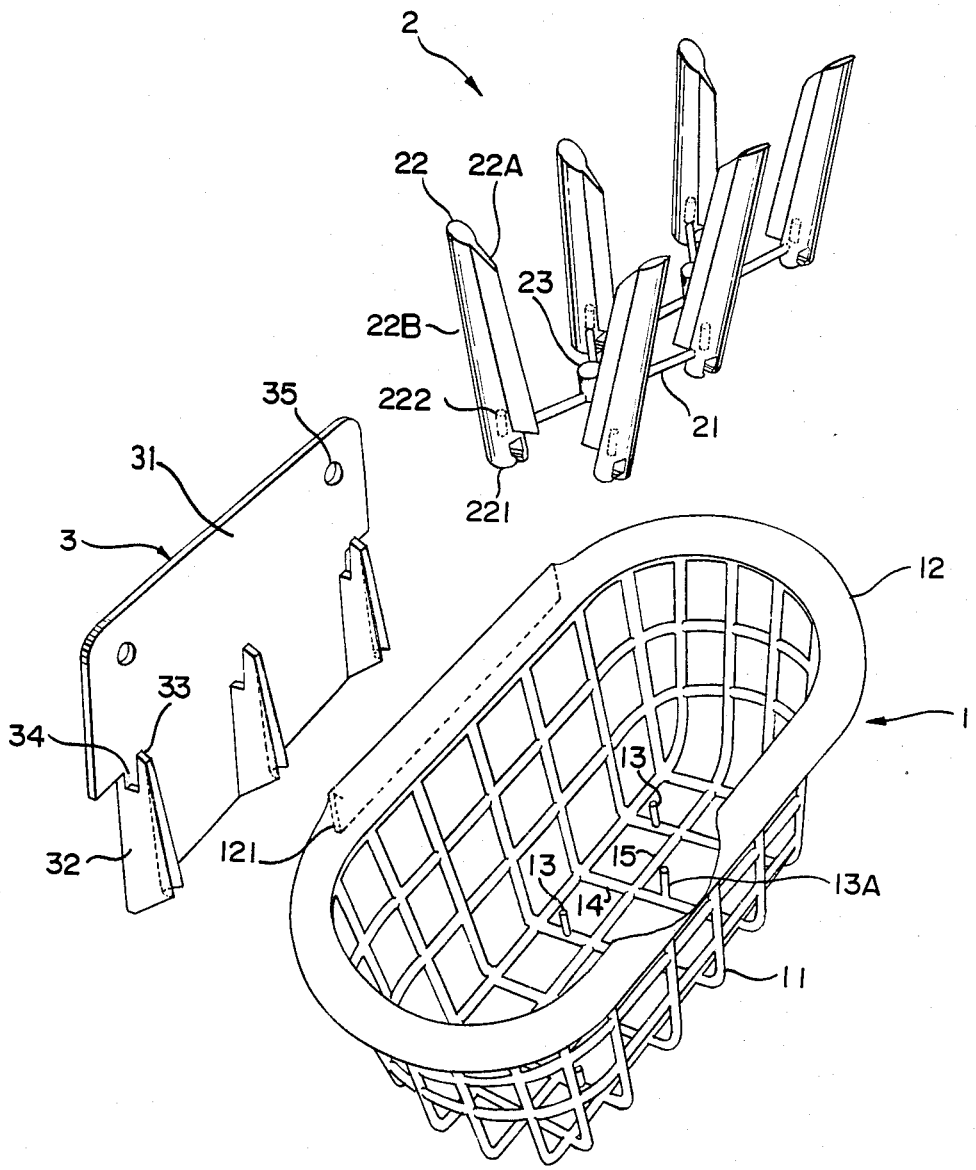
FIG. 2 is an exploded, oblique perspective view of the soap basket of FIG. 1.

As shown in FIG. 2, basket 1 comprises a grille-like frame work 11 formed into a tray shape with a plurality of longitudinal and transversal frame members 15, 14 spacially arranged and cross-joined, and a flange 12 along the upper edge of frame work 11. A plurality of mounting studs 13 and 13A are provided at selected points on the transversal frame members of the bottom part of basket 1 to correspond with blind mounting holes 222 and 231 of soap holder 2 (FIG. 3) to be explained below. One side of flange 12 is formed into an L-shape, having a tongue 121 bent downwards.

Figure 3:
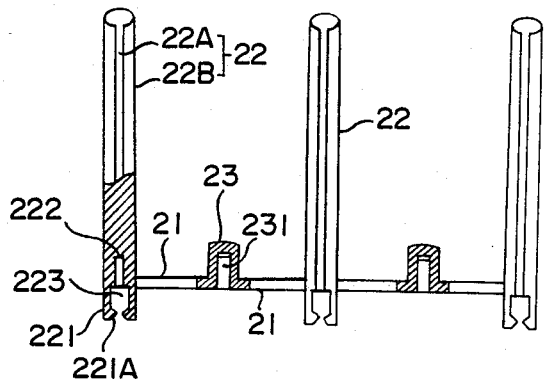
FIG. 3 is a longitudinal cross sectional view of the soap holder, showing the arrangement of one row of the bar members, with one bar member partially cut away.

Soap holder 2, as shown in FIGS. 2 and 3, comprises a plurality of bar members 22 oppositely arranged into two rows spaced apart from each other, each bar member being generally disposed upright, wherein the bar members of one row are spacially arranged in parallel to correspond with the bar members of the opposite, second row. The soap holder 2 has a spacing between the upper ends of each two opposite bar members larger than the spacing between the lower ends, so as to facilitate the placing of a bar of soap upright between the two rows of bar members 22. Each bar member 22 has a generally cylindrical bar body 22B and a ridge 22A formed along the inner side of bar body 22B as shown in FIG. 2, with the lower end of bar body 22B diagonally connected with the lower end of the bar body of another bar member of the opposite row of bar members by a brace member 21, so that a bottom frame work of cross-patterns is formed between the lower ends of the two rows of bar members 22. At each cross point of brace members 21 a stud 23 is provided for supporting a bar of soap to be placed between the two rows of bar members 22 of soap holder 2, each stud 23 having a blind mounting hole 231, as shown in FIG. 3, to correspond with one of mounting studs 13A shown in FIG. 2.

As shown in FIGS. 2 and 3, the lower end of bar body 22B of each bar member 22 of soap holder 2 is further provided with a blind mounting hole 222 to correspond with one of mounting studs 13, and a pair of forks 221 integrally formed with and extending from the lower end of bar body 22B, forks 221 having a slot 223 into which transversal frame member 14 may snugly fit. Fork 221 are also provided with projections 221A from the inner side of the end of the forks 221 for enfolding a transversal frame member 14 when holder 2 is placed in basket 1, with each blind mounting hole 222 of bar members 22 engaged with corresponding mounting sutd 13 and respective transversal frame member 14 snugly fit into slot 223 of forks 221, while at the same time blind mounting hole 231 of each stud 23 is engaged with corresponding mounting stud 13A.

Soap holder 2 may be made of plastic or rubber so as to provide a certain degree of elasticity and resiliency.

Figure 4:
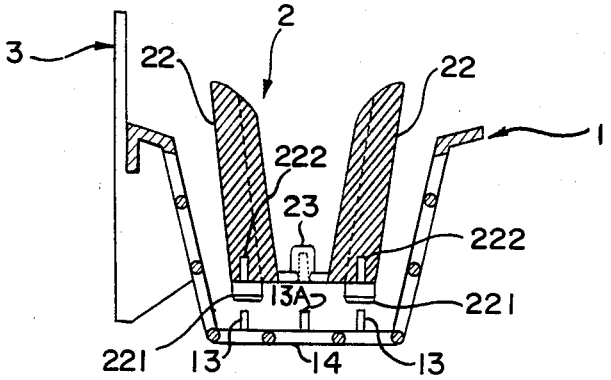
FIGS. 4 and 5 are transversal, cross-sectional views of the soap basket of this invention, showing the process of assembling the soap holder in the basket.
Figure 5:
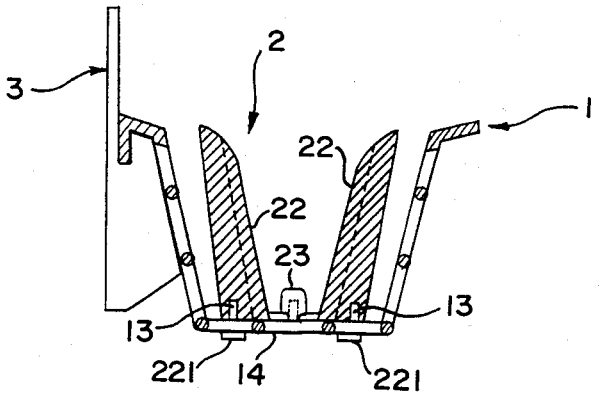

Mounting studs 13 and 13A on the bottom frame work of basket 1 are arranged to respectively correspond with blind mounting holes 222 of bar members 22 and blind mounting holes 231 of studs 23 respectively of holder 2 as described above. To assemble soap holder 2 in basket 1, blind mounting holes 222 of bar members 22 and blind mounting holes 231 of stud 23 of holder 2 are first respectively aligned with corresponding mounting studs 13 and 13A with slots 223 of forks 221 aligned with corresponding transversal frame members 14, as shown in FIG. 4. Then holder 2 is forced downwards, causing each pair of forks 221 to resiliently slip past corresponding transversal frame member 14 as shown in FIG. 5, and at the same time causing blind mounting holes 222 at the lower ends of bar members 22 and blind mounting holes 231 of studs 23 to fit over respective mounting sutds 13 and 13A on the bottom part of basket 1. Holder 2 may be removed from basket 1 by pulling holder 2 upwards, causing forks 221 to expand resiliently, thus allowing forks 221 to release transversal frame members 14 and the lower ends of bar members 22 and studs 23 to disengage from mounting studs 13 and 13A.

Hanger plate 3, as shown in FIG. 2, comprises a planar board 31 and a plurality of parallel vertical ribs 32 provided on one side of board 31, each rib 32 having a tip 33 and a notch 34 in which tongue 121 of flange 12 of basket may engage. Board 31 has two mounting holes 35 through which capscrews or nails, not shown, may pass in order to fix hanger plate 3 onto a wall.

Basket 1 with or without soap holder 2 may be hung on hanger plate 3 with tongue 121 of flange 12 of basket 1 engaged in notches 34 of ribs 32, as shown in FIG. 5.

With soap holder assembled in basket 1, and with basket 1 hung on hanger plate 3 which is fixed on a wall of a bathroom, one may conveniently place a wet bar of soap, not shown, in soap holder without fear of soaking the soap in water.

Figure 6:
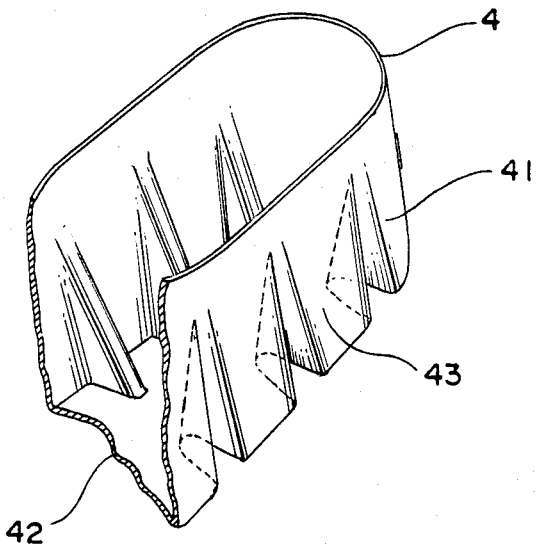
FIG. 6 is an oblique, partially cut away, perspective view of a vessel-like adaptor to be used alternatively to convert the soap basket into a wall vase.

The soap basket of this invention may alternatively be converted into a wall vase by placing in basket 1 a vessel-like adaptor 4 capable of containing water, as shown in FIG. 6. Vessel-like adaptor 4 has side wall 43 provided with slots 41 to correspond with bar members 22 of soap holder 2, and bottom 42 to lie on top of studs 23 of soap holder 2, so that vessel-like adaptor 4 may be placed in basket 1 without removing soap holder 2.

What is claimed is:

1. A basket assembly, comprising:

a basket composed of a grille-like frame work formed of a plurality of longitudinal frame members and a plurality of transversal frame members cross joined with said longitudinal frame members, a flange on the upper edge of the basket having a tongue bent downward, and a plurality of mounting studs at selected points of said transversal frame member at the bottom of the basket;

a holder composed of a plurality of bar members oppositely and spacially arranged in two rows having lower parts connected by a cross-formed frame work, each one of said bar members being generally disposed upright and having a lower end provided with a blind mounting hole to be engaged with one of said studs of said basket, and a pair of forks having a slot in which said transversal frame member fits, said pair of forks having a pair of projections from the inner side of the end of the forks for enfolding the transversal frame member; and a hanger plate having means for hanging said basket.

2. A basket assembly of claim 1, wherein said means for hanging said basket is a plurality of ribs formed on one side face of said hanger plate, each one of said ribs having an upper end provided with a notch in which said tongue of the flange of said basket may fit.

3. A basket assembly of claim 1, wherein said holder is provided with a supporting stud extending upward from each cross point of said cross-formed frame work.

4. A basket assembly of claim 1 or 2, which further comprises a vessel-like adaptor capable of containing water, said vessel-like adaptor having a side wall formed with slots to correspond with said bar members, and a bottom adapted to lie on top of said supporting studs of said holder.

5. A basket assembly of claim 1, wherein said bar members are each provided with a ridge along the inner side of said bar member.

6. A basket assembly of claim 1, wherein said holder is made of an elastic material having a certain resiliency.

* * * * *

UNITED STATES PATENT AND TRADEMARK OFFICE

CERTIFICATE OF CORRECTION

PATENT NO. : 4,530,479

DATED : July 23, 1985

INVENTOR(S) : JASON KUO-SEN CHEN

It is certified that error appears in the above-identified patent and that said Letters Patent is hereby corrected as shown below:

On the title page;

Please correct the Patentee's Name to read:

JASON KUO-SEN CHEN

Signed and Sealed this

*Twenty-second* Day of *October 1985*

[SEAL]

*Attest:*

DONALD J. QUIGG

*Attesting Officer*

*Commissioner of Patents and Trademarks—Designate*